US005325825A

United States Patent [19]

Schmidt et al.

[11] Patent Number: 5,325,825

[45] Date of Patent: Jul. 5, 1994

[54] FINGER LEVER OR ROCKER ARM FOR A VALVE ACTUATING MECHANISM OF AN INTERNAL COMBUSTION PISTON ENGINE

[75] Inventors: Dieter Schmidt, Nuernberg; Arndt Ihlemann, Herzogenaurach, both of Fed. Rep. of Germany

[73] Assignee: Ina Walzlager Schaeffler KG, Fed. Rep. of Germany

[21] Appl. No.: 136,581

[22] Filed: Oct. 13, 1993

[30] Foreign Application Priority Data

Oct. 16, 1992 [DE] Fed. Rep. of Germany ..... 4234868

[51] Int. Cl.[5] ..... F01L 1/18

[52] U.S. Cl. ..... 123/90.39; 123/90.36; 123/90.42; 74/559

[58] Field of Search ..... 123/90.36, 90.39, 90.4, 123/90.41, 90.42, 90.43, 90.44, 90.45, 90.46; 74/519, 559

[56] References Cited

U.S. PATENT DOCUMENTS

| | | | |
|---|---|---|---|
| 2,322,172 | 6/1943 | Spencer | 123/90.44 |
| 3,400,696 | 9/1968 | Thompson | 123/90.42 |
| 4,944,257 | 7/1990 | Mills | 123/90.39 |
| 5,016,582 | 5/1991 | Mills | 123/90.39 |
| 5,048,475 | 9/1991 | Mills | 123/90.39 |
| 5,063,889 | 11/1991 | Pryba et al. | 123/90.39 |
| 5,172,663 | 12/1992 | Fujiwara | 123/90.36 |
| 5,186,130 | 2/1993 | Melchior | 123/90.36 |

*Primary Examiner*—Raymond A. Nelli
*Assistant Examiner*—Weilun Lo
*Attorney, Agent, or Firm*—Bierman and Muserlian

[57] ABSTRACT

A finger lever or a rocker arm (4,25,39) for a valve actuating mechanism (1) of an internal combustion piston engine comprising a roller (5) which rolls against the periphery of a cam (3) and is rotatably mounted on a pin (17) guided in side walls (18,19) of the finger lever or the rocker arm (4,25,39) which is provided with a bore (23) directed towards the periphery of the roller (5) and communicating with a lubricant duct (38), characterized in that the bore (23,27,43) has a diameter of ≦0.5 mm in the region of its smallest cross-section.

6 Claims, 3 Drawing Sheets

Figure 1:
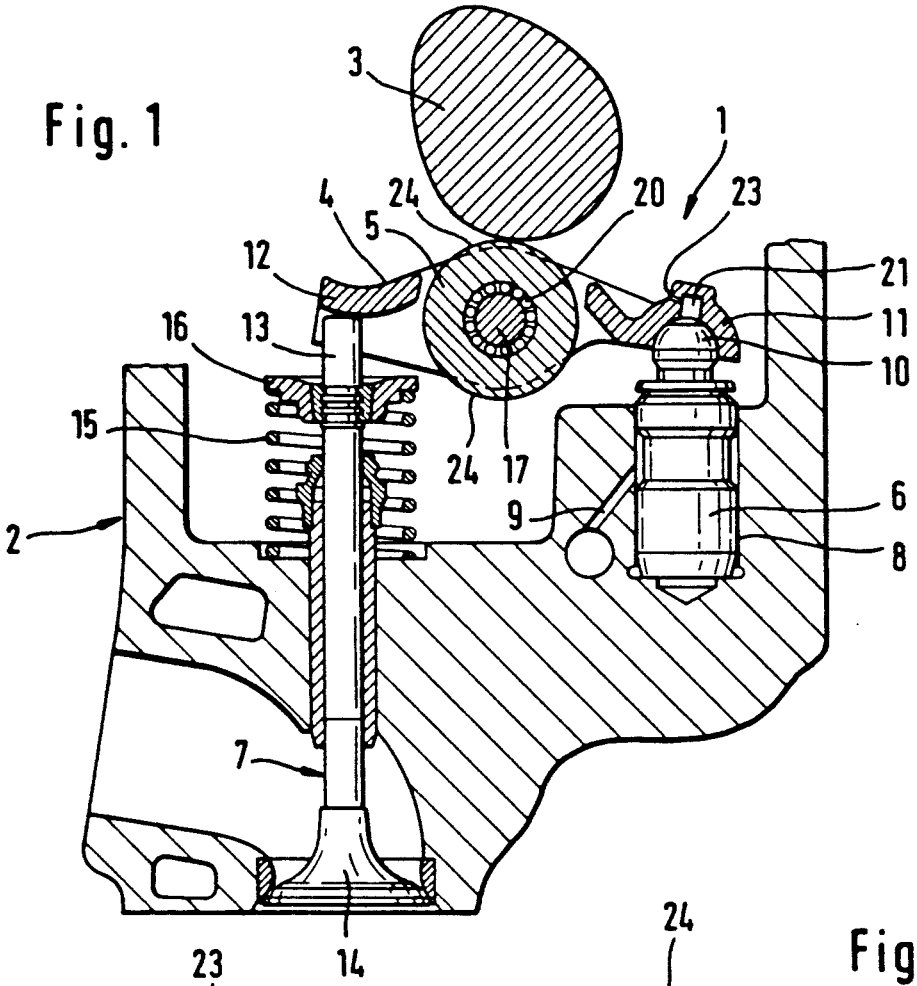

FINGER LEVER OR ROCKER ARM FOR A VALVE ACTUATING MECHANISM OF AN INTERNAL COMBUSTION PISTON ENGINE

STATE OF THE ART

Finger levers or rocker arms for a valve actuating mechanism of an internal combustion piston engine comprising a roller which rolls against the periphery of a cam and is rotatably mounted on a pin guided in side walls of the finger lever or the rocker arm which is provided with a bore directed towards the periphery of the roller and communicating with a lubricant duct are known. A finger lever of this type is known from U.S. Pat. No. 2,322,172. This finger lever is pivotally mounted in a side wall of a cylinder head and its other end engages the end of a valve shaft via an intermediary. A lubricant duct leads from the mounting of the finger lever to the intermediary which can turn in a cylindrical recess during valve actuation. A part of the lubricant duct located in the intermediary communicates phase-wise with the bore which, although directed towards the roller, only serves to fill a trough-shaped recess surrounding the roller with lubricant. The oil sump created in this way in the region of the roller has substantial disadvantages. Firstly, the oil contained in the trough causes an undesired moment of drag at the roller and secondly, harmful deposits can be formed in this trough during the operation of the internal combustion piston engine leading to a premature failure of the mounting arrangement of the roller. Besides this, due to an undesired thick lubricant film layer on the running surface of the roller, there arises the problem of slip between the roller and the cam.

OBJECTS OF THE INVENTION

It is an object of the invention to avoid these disadvantages by providing a device which enables a dosed lubrication of the running face of the roller and its mounting arrangement by simple means.

This and other objects and advantages of the invention will become obvious from the following detailed description.

THE INVENTION

The novel finger lever or rocker arm of the invention for a valve actuating mechanism (1) of an internal combustion piston engine comprising a roller (5) which rolls against the periphery of a cam (3) and is rotatably mounted on a pin (17) guided in side walls (18,19) of the finger lever or the rocker arm (4,25,39) which is provided with a bore (23) directed towards the periphery of the roller (5) and communicating with a lubricant duct (38) is characterized in that the bore (23,27,43) has a diameter of $\leqq 0.5$ mm in the region of its smallest cross-section.

Due to the small bore diameter, a very fine stream of lubricant can be applied directly to the running face of the roller facing the cam. Because of the small cross-section of the bore, there is hardly any pressure loss in the entire lubricant and hydraulic system of the cylinder head. Considering the large number of finger levers involved, a larger bore cross-section could cause a considerable reduction of lubricant pressure and possibly, also of hydraulic oil pressure.

In a further advantageous development of the invention, the bore extends essentially tangentially with respect to the roller so that this roller can be advantageously wet in a controlled manner in its upper region facing the cam, and the lubricant can flow from there along the end faces of the roller to the mounting thereof. The roller may be mounted on the pin with the help of a needle bearing. The needle bearing with its compact structure is particularly suitable for the mounting of the roller in a finger lever or a rocker arm, the needle bearing being designed to meet the specific requirements for the mounting of rollers i.e. high centrifugal and acceleration forces and high rotational speeds. The mounting of the roller is further subjected to high alternating stresses for which again the needle bearing is particularly suitable.

To meet these requirements, the needle bearing can comprise a ring of needles guided directly on the pin and in a bore of the roller and, due to the high rotational speeds involved and the high loading of the roller, the needle bearing requires intensive lubrication combined with heat dissipation. It is true that in certain operational phases of the internal combustion piston engine, an oil mist perhaps sufficient for an adequate lubrication of the needle bearing can be formed in the space in which the valve actuating mechanism is lodged but in other phases, this is not the case. It is therefor necessary to spray the roller with lubricant via the bore so that a part of the lubricant flows along the end faces of the roller and penetrates into the needle bearing to ensure an adequate lubrication and cooling thereof.

In another embodiment, the finger lever or the rocker arm which can be made preferably as a shaped sheet metal part, comprises in the region of the roller, only the side walls for receiving the pin, that is to say, it has a through aperture. In this way the lubricant sprayed onto the roller and flowing through the needle bearing can be carried away and does not collect in the finger lever or the rocker arm. Thus a constant exchange of lubricant is assured.

A spherical cup on one end of the finger lever may engage a spherical end portion of a support member comprising a hydraulic lash adjustor, and lubricant from an oil reservoir of the hydraulic lash adjuster arranged within the support member can be transferred into the bore via the lubricant duct which extends partly through the spherical end portion and partly through the spherical cup. Thus, the lubrication of the roller can be combined with the hydraulic medium supply to the lash adjuster and only very short portions of a lubricant duct are required in the support member and the spherical cup of the finger lever. This simplifies manufacturing of such a lubricating device, the stability of the finger lever remains practically unaffected and such a lubricating device can be provided without any problem even in a finger lever made as a shaped sheet metal part. It is, of course, important when a part of the pressure medium of the reservoir of the lash adjuster is tapped for supply to the lubricating device to keep the pressure loss as low as possible, a pre-requisite for this is the small bore cross-section of the invention.

Further, there may be projecting outward from the spherical cup of the finger lever a dome along whose longitudinal center line the lubricant duct configured as a pocket bore extends, the bore of the finger lever being arranged at an angle to this lubricant duct. Thus, hydraulic medium is transferred from the reservoir into this pocket bore from where it flows out through the bore serving for lubrication at an angle extending tangentially with respect to the roller. Such a lubricant duct is simple and inexpensive to manufacture.

A further development of the invention provides a rocker arm in which the lubricant duct leads from the mounting of the rocker arm to the bore which opens at a surface of the rocker arm extending radially with respect to the roller. This surface of the rocker arm extending radially with respect to the roller constitutes the base of a fork-shaped portion of the rocker arm formed by the side walls. It is possible to arrange the bore in the transverse center plane of the roller or on both sides of the transverse center plane at a distance therefrom so that by reason of the spraying direction, it is assured that at least a portion of the lubricant penetrates into the mounting of the roller.

Finally, a method of making a lubricating device for a finger lever or a rocker arm comprises a roller of this invention wherein a bore serving as a lubricating device is made with the help of a laser beam. To make the bore with a diameter of ≦0.5 mm by drilling is not unproblematic. Therefore, to simplify this machining operation, the use of laser technics is recommended.

REFERRING NOW TO THE DRAWINGS

Figure 2:
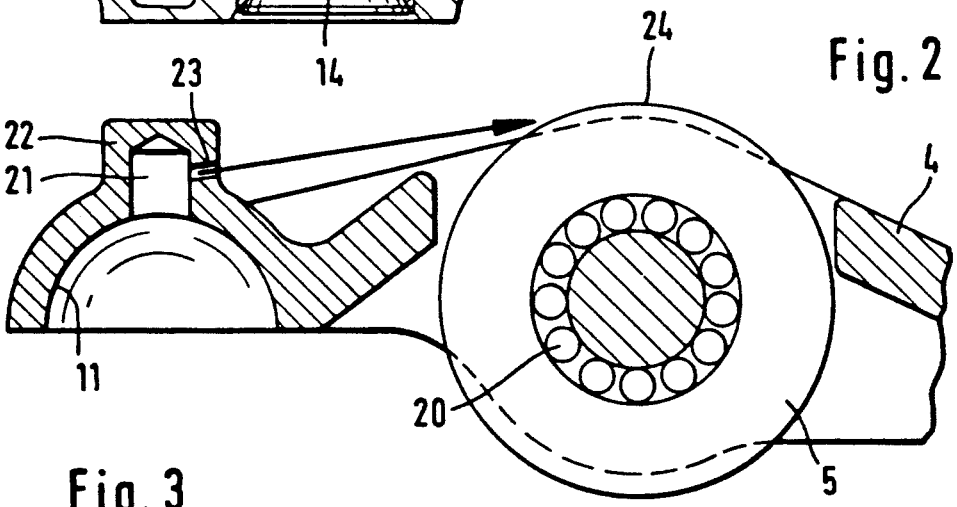
Figure 3:
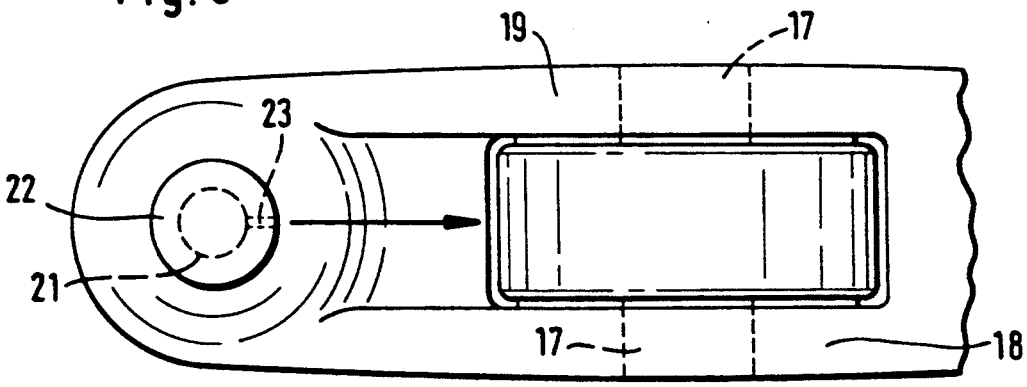
Figure 4:
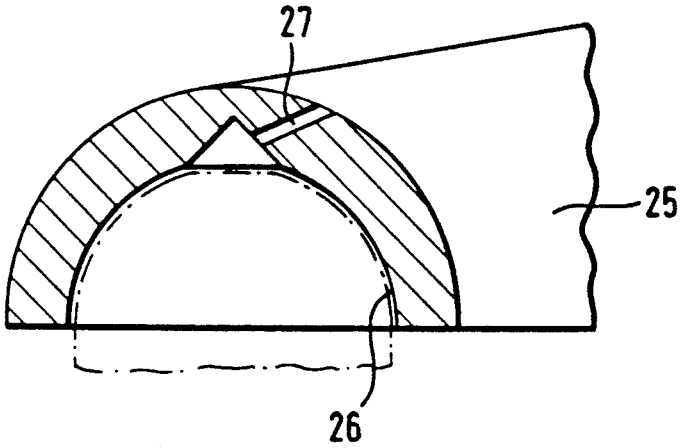
Figure 5:
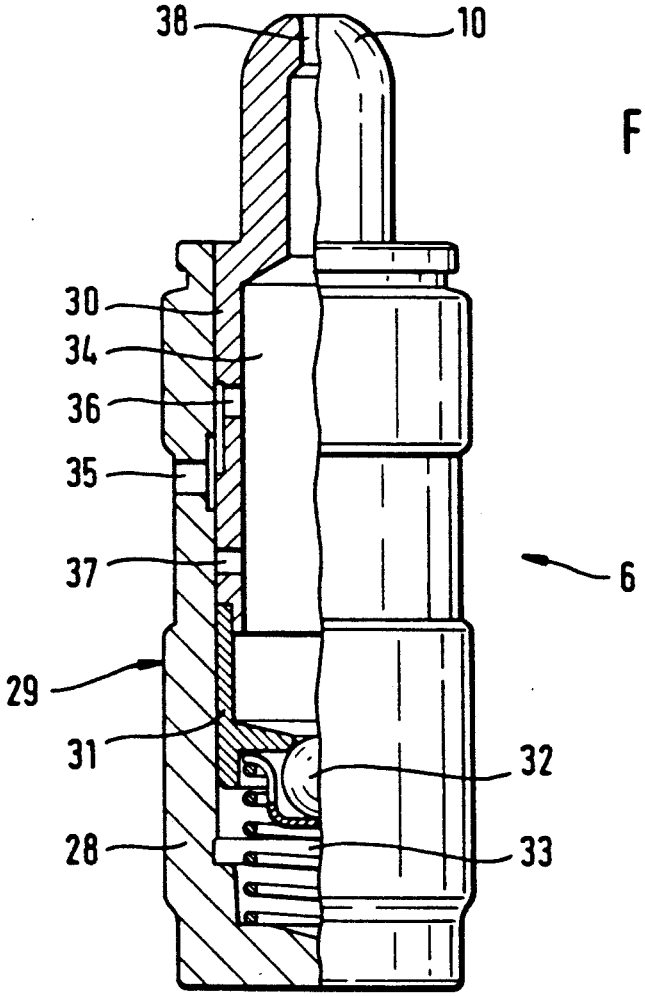

FIG. 1 is a partial cross-sectional view of a valve actuating mechanism with a finger lever, FIG. 2 is an enlarged partial cross-sectional view of the finger lever of FIG. 1, FIG. 3 is a top view of the finger lever of FIG. 2, FIG. 4 is a partial section of a finger lever in the region of its spherical cup with the bore arranged directly in the spherical cup, FIG. 5 is a semi-section of the support member of FIG. 1

Figure 6:
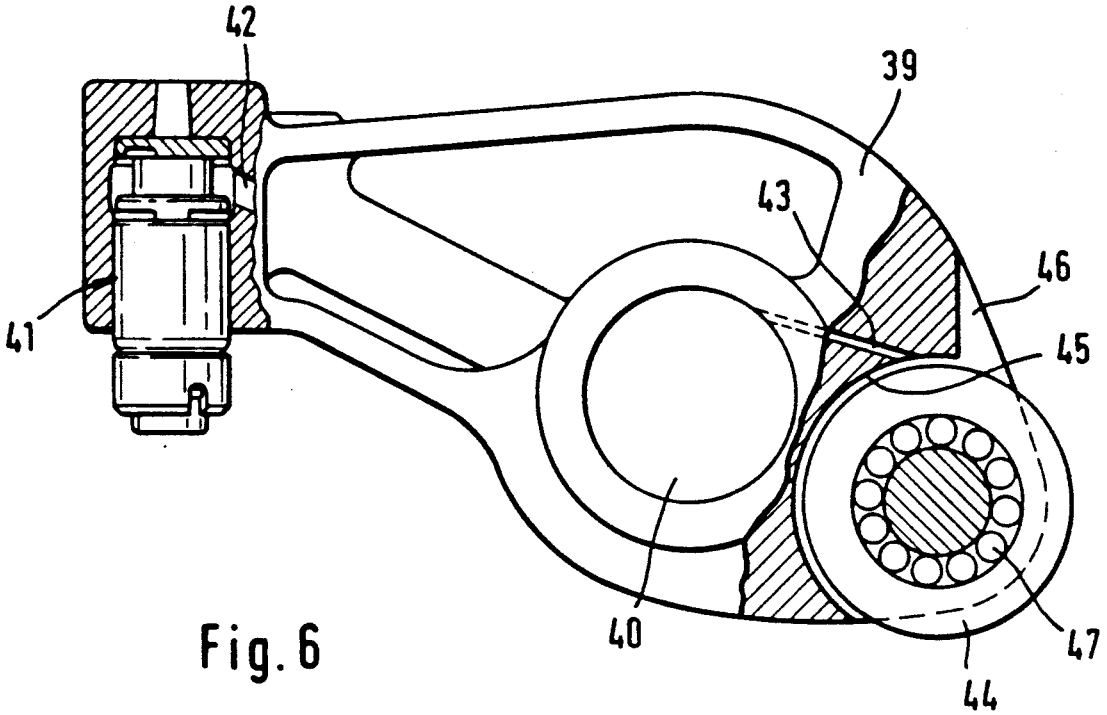
Figure 7:
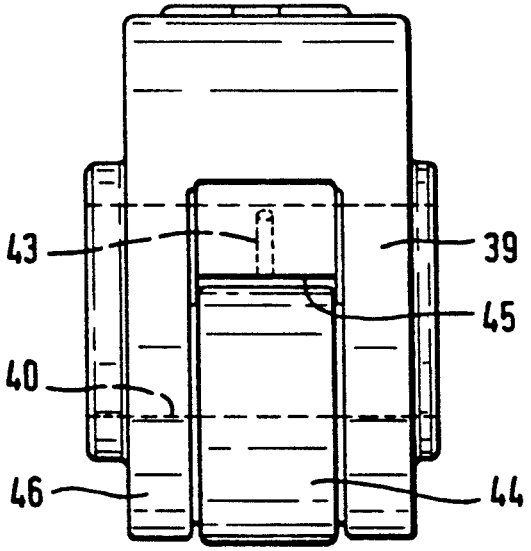

FIG. 6 is a partial cross-section view of a rocker with a roller and an insertion-type lash adjuster, and FIG. 7 is a view of the part of the rocker arm of FIG. 6 where the roller is lodged.

In FIG. 1, a valve actuating mechanism of an internal combustion piston engine arranged in a cylinder head 2, only partly represented, is identified at 1. The valve actuating mechanism 1 comprises a cam 3 of a camshaft (not shown), a finger lever 4 with a roller 5, a support member 6 and an engine valve 7. The support member 6 whose construction will be described more closely in connection with FIG. 5, is arranged in a receiving bore 8 of the cylinder head 2 and is supplied with oil via a delivery bore 9. The support member further comprises a spherical end portion 10 on which a spherical cup 11 of the finger lever is supported.

As can be seen from FIG. 1, the finger lever 4 can be made as a shaped sheet metal part with a generally U-shaped cross-section. An end 12 of the finger lever 4 located opposite the spherical cup 11 engages a valve shaft 13 of the engine valve 7. The engine valve 7 which further comprises a valve head 14 is biased in its closing direction by a valve spring 15 which is retained axially on the valve shaft 13 by a spring retainer 16. As can be seen in FIG. 3, the roller 5 is guided by a pin 17 in side walls 18 and 19 of the finger lever 4. A needle bearing 20 serves to mount the roller 5 rotatably on pin 17 which is fixed in the side walls 18 and 19. A rotation of the cam 3 causes the roller 5 to roll along the periphery of the cam 3. As can further be seen in FIG. 1, a pocket bore 21 is provided within the spherical cup 11 while a dome 22 projects outward from the spherical cup. In this dome 22, and extending at an angle to the pocket bore 21, there is provided a bore 23 through which a fine stream of lubricant directed tangentially with respect to the roller 5 can be applied to the running face 24 of the roller 5.

For a closer description of the spherical cup 11 and the bore 23, reference is made to FIGS. 2 and 3. In FIG. 2, in which the spherical cup 11 is shown on a larger scale, it can be seen that lubricant sprayed from the pocket bore 21 via the bore 23 onto the running face 24 of the roller 5 follows the path indicated by the arrow. FIG. 3 shows further that the stream of lubricant emerging from the bore 23 impinges on the running face 24 in the region of the transverse center plane of the roller 5. A part of the lubricant reaching the running face 24 flows along the end faces of the roller 5 into the needle bearing 20.

FIG. 4 shows another alternative embodiment of a finger lever 25 wherein a bore 27 is arranged directly in the spherical cup thereof, that is to say, as compared with the embodiment of FIGS. 1 to 3, a dome 22 is not provided.

FIG. 5 illustrates the support member 6 which essentially comprises a housing 28 and a lash adjuster 29 arranged in the housing. For this purpose, a structure comprising a piston upper part 30 and a piston lower part 31 is slidably guided in the housing 28. A high pressure chamber 33 is arranged at a front end of the piston lower part 31 in which a ball valve 32 is lodged, while the piston upper and lower parts, 30 and 31, together define an oil reservoir 34 in their interior. The lubricant from the delivery bore 9 which is shown in FIG. 1, can be transferred via further supply bores 35, 36 and 37 into the oil reservoir 34. The spherical end portion 10 on which, as shown in FIG. 1, the spherical cup 11 is supported, is formed at one end of the piston upper part. A first part of a lubricant duct 38 extends along the longitudinal center line of this spherical end portion 10. The oil flowing out of the oil reservoir 34 through this first part of the lubricant duct 38 flows, as can be seen in FIGS. 1 and 2 into the pocket bore 21 from where it is sprayed onto the running face 24 of the roller 5 through the bore 23 which has a diameter of ≦0.5 mm.

FIGS. 6 and 7 are illustrations of a rocker arm 39 which is pivoted on an axle 40 in a cylinder head, now shown. At one end, the rocker arm 39 comprises a lash adjuster 41 which is made in the form of an insert and normally cooperates with an end of a valve shaft of an engine valve. The lash adjuster 41 is fed with pressure medium via a supply bore 42, the pressure medium being transferred from the lubricant circuit of the cylinder head in the region of the axis of this supply bore 42. Lubricant is also transferred from the axle 40 of the rocker arm 39 into a bore 43 which opens at a base 45 of a fork-shaped portion 46 of the rocker arm 39, the base 45 extending radially with respect to a roller 44. Through this bore 43, which likewise has a diameter of ≦0.5 mm, oil is transferred from the mounting of the rocker arm 39 onto the peripheral surface of the roller 44 and thus, also into a needle bearing 47 of the roller 44. From FIG. 7, it can be seen that the bore 43 is arranged in the base 45 in the region of the transverse center plane of the roller 44. Moreover, it is also possible to provide two bores and arrange them so that each bore serves to spray one half of the running face of the roller 44 and feed lubricant to the needle bearing 47.

Various modifications of finger levers and rocker arms of the invention may be made without departing from the spirit or scope thereof and it is to be understood that the invention is intended to be limited only as defined in the appended claims.

What we claim is:

1. A finger lever or a rocker arm (4,25,39) for a valve actuating mechanism (1) of an internal combustion piston engine comprising a roller (5) which rolls against the periphery of a cam (3) and is rotatably mounted on a pin (17) guided in side walls (18,19) of the finger lever or the rocker arm (4,25,39) which is provided with a bore (23) directed towards the periphery of the roller (5) and communicating with a lubricant duct (38), characterized in that the bore (23,27,43) has a diameter of at least one of equal and less than one half of a millimeter in the region of its smallest cross-section and extends essentially tangentially with respect to the periphery of the roller (5, 44).

2. A rocker arm (39) of claim 1 wherein a second lubricant duct (42) leads from a mounting of the rocker arm (39) to the bore (43) which opens at a surface of the rocker arm (39) which extends tangentially with respect to a roller (44).

3. A finger lever or a rocker arm (4,25,39) of claim 1 wherein the roller (5,44) is mounted on the pin (17) with the help of a needle bearing (20,47).

4. A finger lever or a rocker arm (4,25,39) of claim 1 wherein the finger lever or the rocker arm (4,25,39) made as a shaped sheet metal part comprises only side walls (18,19) in its region in which the roller (5,44) is arranged.

5. A finger lever (4,25) of claim 1 wherein a spherical cup (11) on one end of the finger lever (4,25) engages a spherical end portion (10) of a support member (6) comprising a hydraulic lash adjuster (29), and lubricant from an oil reservoir (34) of the hydraulic lash adjuster (29) arranged within the support member (6) is transferred into the bore (23,27) via the lubricant duct (38) which extends partly through the spherical end portion (10) and partly through the spherical cup (11).

6. A finger lever (4) of claim 5 wherein projecting outward from the spherical cup (11) of the finger lever (4) is a dome (22) along whose longitudinal center line the lubricant duct (38) configured as a pocket bore (21) extends, the bore (23) being arranged at an angle to this lubricant duct (38). r

* * * * *